US008225619B2

(12) United States Patent
Okuda et al.

(10) Patent No.: US 8,225,619 B2
(45) Date of Patent: Jul. 24, 2012

(54) AIR-REFRIGERANT COOLING APPARATUS WITH A WARM GAS DEFROST BYPASS PIPE

(75) Inventors: Seiichi Okuda, Kanagawa (JP); Masato Mitsuhashi, Kanagawa (JP)

(73) Assignees: Mitsubishi Heavy Industries, Ltd, Tokyo (JP); International Center for Environmental Technology Transfer, Mie (JP)

( * ) Notice: Subject to any disclaimer, the term of this patent is extended or adjusted under 35 U.S.C. 154(b) by 0 days.

(21) Appl. No.: 12/913,505

(22) Filed: Oct. 27, 2010

(65) Prior Publication Data

US 2011/0041526 A1 Feb. 24, 2011

Related U.S. Application Data

(63) Continuation of application No. 10/538,177, filed as application No. PCT/JP2005/010115 on Jun. 2, 2005, now abandoned.

(30) Foreign Application Priority Data

Jul. 30, 2004 (JP) ..... 2004-224964

(51) Int. Cl.
*F25D 17/06* (2006.01)
*F25D 21/00* (2006.01)
*F25D 9/00* (2006.01)

(52) U.S. Cl. ..... 62/93; 62/272; 62/401; 62/402

(58) Field of Classification Search ..... 62/93, 272, 62/402

See application file for complete search history.

(56) References Cited

U.S. PATENT DOCUMENTS

| | | | | |
|---|---|---|---|---|
| 2,118,949 | A | 5/1938 | Scott | |
| 2,706,894 | A * | 4/1955 | Shoemaker | 62/152 |
| 2,733,574 | A * | 2/1956 | Reber | 62/198 |
| 3,355,903 | A | 12/1967 | La Fleur | |
| 3,696,637 | A | 10/1972 | Ness et al. | |
| 4,328,684 | A | 5/1982 | Leo | |
| 4,483,153 | A | 11/1984 | Wallace | |
| 4,730,464 | A * | 3/1988 | Lotz | 62/401 |
| 5,014,521 | A | 5/1991 | Sakai et al. | |
| 5,237,837 | A | 8/1993 | Naruse et al. | |
| 5,248,239 | A | 9/1993 | Andrews | |
| 5,644,928 | A * | 7/1997 | Uda et al. | 62/402 |
| 5,884,498 | A | 3/1999 | Kishimoto et al. | |

(Continued)

FOREIGN PATENT DOCUMENTS

EP 1130331 A2 9/2001

(Continued)

OTHER PUBLICATIONS

JP 11-132582, Kato Satoshi et al.—Translation (Continued)

*Primary Examiner* — Marc Norman
*Assistant Examiner* — Filip Zec
(74) *Attorney, Agent, or Firm* — Kanesaka Berner & Partners, LLP

(57) ABSTRACT

The present invention provides a technique for rapidly removing frost accumulated in air-refrigerant cooling apparatuses. An air-refrigerant cooling apparatus in accordance with the present invention includes a bypass line for directly supplying a defroster with refrigerant air having an increased temperature from a compressor, avoiding temperature drop by a heat exchanger and an expansion turbine. Moisture of the frost melted in the defroster is externally exhausted by a fan.

12 Claims, 5 Drawing Sheets

U.S. PATENT DOCUMENTS

| | | | | |
|---|---|---|---|---|
| 5,924,307 | A | 7/1999 | Nenov | |
| 6,148,622 | A | 11/2000 | Sanger | |
| 6,151,909 | A | 11/2000 | Carter et al. | |
| 6,164,084 | A | 12/2000 | Watson et al. | |
| 6,415,621 | B2 | 7/2002 | Buchholz et al. | |
| 6,481,232 | B2 | 11/2002 | Faqih | |
| 6,848,261 | B2 | 2/2005 | Claeys | |
| 7,040,100 | B2 * | 5/2006 | Feisthauer | 62/63 |

FOREIGN PATENT DOCUMENTS

| | | | |
|---|---|---|---|
| GB | 2237373 | A | 5/1991 |
| JP | 05-106944 | A | 4/1993 |
| JP | 06-034212 | A | 2/1994 |
| JP | 06-101498 | A | 4/1994 |
| JP | 61-27994 | A | 5/1994 |
| JP | 07-091760 | A | 4/1995 |
| JP | 07324789 | | 12/1995 |
| JP | 08-061366 | | 3/1996 |
| JP | 9196485 | A | 7/1997 |
| JP | 09-217976 | A | 8/1997 |
| JP | 9236341 | A | 9/1997 |
| JP | 10089823 | A | 4/1998 |
| JP | 10-148408 | A | 6/1998 |
| JP | 10-160195 | A | 6/1998 |
| JP | 10-267444 | A | 10/1998 |
| JP | 11-55899 | A | 2/1999 |
| JP | 11063792 | A | 3/1999 |
| JP | 11-132582 | A | 5/1999 |
| JP | 11-132583 | A | 5/1999 |
| JP | 2000002481 | A | 1/2000 |
| JP | 2000314569 | A | 11/2000 |
| JP | 2000-356425 | A | 12/2000 |
| JP | 2001-123997 | A | 5/2001 |
| JP | 2001-221551 | A | 8/2001 |
| JP | 2002-112475 | A | 4/2002 |
| JP | 2002-120000 | A | 4/2002 |
| JP | 2003-83634 | A | 3/2003 |
| JP | 2003-302116 | A | 10/2003 |
| JP | 2003287298 | A | 10/2003 |
| JP | 08-061821 | | 10/2010 |
| KR | 20030031540 | A | 4/2003 |
| WO | 8603825 | A1 | 7/1986 |

OTHER PUBLICATIONS

JP 10-267444 A (Nippon Sanso Corporation) Oct. 9, 1998.; JP 9-178323 A (Hitachi Plant Engineering & Construction Co., Ltd.) Jul. 11, 1997.; JP 56-18883 U (Toyo Engineering Works, Ltd.) Feb. 19, 1981.; JP 6-32123 U (Nippon Fruehauf Company, Ltd.) Apr. 26, 1994, Document and Explanation.

European Search Report dated Sep. 5, 2011.

Japanese Office Action for JP2006-528433, mailed Mar. 13, 2009.

Japanese Office Action for JP2006-527788, mailed Aug. 6, 2009.

Japanese Office Action for JP2006-546517, mailed Aug. 6, 2009.

International Search Report and Search Opinion for PCT/JP2004/017712, mailed Mar. 15, 2005.

Japanese Office Action for JP2006-527781, mailed Mar. 16, 2009.

Office Action for U.S. Appl. No. 10/524,692, mailed Apr. 28, 2009.

Trial Decision for JP2006-527788, mailed May 11, 2011.

Office Action for U.S. Appl. No. 10/538,177, mailed Oct. 7, 2009.

European Search Report for 04822210.3 dated Feb. 29, 2012.

* cited by examiner

AIR-REFRIGERANT COOLING APPARATUS WITH A WARM GAS DEFROST BYPASS PIPE

CROSS-REFERENCE TO RELATED APPLICATIONS

The present application is a Continuation of U.S. application Ser. No. 10/538,177, filed Jun. 9, 2005, which is a U.S. National Stage of International Application Number PCT/JP2005/10115, filed Jun. 2, 2005, claiming priority of Japanese Application Number 2004-224964, filed Jul. 30, 2004 and is related to U.S. application Ser. Nos. 10/524,692, filed Feb. 15, 2005, 10/524,631, filed Feb. 16, 2005, and 10/524,877, filed Feb. 17, 2005, the disclosures of which are hereby incorporated by reference in their entirety.

TECHNICAL FIELD

The present invention relates to cooling apparatuses using air as refrigerant.

BACKGROUND ART

Cooling apparatuses using air as refrigerant have been recently developed as alternatives of conventional cooling apparatuses using chlorofluorocarbon as refrigerant.

For example, Japanese Laid Open Patent Publication No. H05-106944 discloses a refrigerating apparatus composed of a compressor, a condenser including a blowing fan, a pressure reducing unit, and an evaporator including a blowing fan, which are sequentially connected. This refrigerating apparatus includes a first switching valve that is provided downstream or upstream of the condenser and that opens and closes a refrigerant channel of the condenser, a first bypass circuit that bypasses this first switching valve and the condenser, a second switching valve that is provided in this first bypass circuit and that opens and closes the first bypass circuit, a second bypass circuit that bypasses the pressure reducing device, and a third switching valve that is provided in this second bypass circuit and that opens and closes the second bypass circuit. The well-known refrigerating apparatus is characterized in that the first switching valve is opened, the second and the third switching valves are closed, and the blowing fan of the condenser and that of the evaporator are activated in a refrigerating operation, and in that the first switching valve is closed, the second and the third switching valves are opened, and at least the blowing fan of the evaporator out of the blowing fan of the condenser and that of the evaporator is deactivated in a defrosting operation.

Additionally, Japanese Laid Open Patent Publication No. H11-132582 discloses an air-refrigerant refrigerating apparatus constituted so that a compressor, an air cooler, an air-to-air heat exchanger, and an expansion unit are arranged in an order of an air flow, that the air in a chamber required to be cooled is taken into the compressor through the air-to-air heat exchanger, and that the air output from the expansion unit is blown off into the chamber. This air-refrigerant refrigerating apparatus is characterized by including a first bypass provided with a valve for returning a part of or all of the air from the expansion unit to the air-to-air heat exchanger while bypassing the chamber, and a hot air bypass provided with a valve for taking in the air at 0° C. or higher from an air passage between the compressor and the expansion unit, and for supplying the air to an air passage on an inlet side of the air-to-air heat exchanger.

Finally, Japanese Laid Open Patent Publication No. H11-132583 discloses an air-cooling facility for taking the air within a chamber required to be cooled into an air-refrigerant refrigerator as a refrigerant, and for blowing off a low temperature air from the air-refrigerant refrigerator into the chamber. This air cooling facility includes a frosting unit arranged in an air passage for supplying the low temperature air from the air-refrigerant refrigerator to the chamber required to be cooled, and means for discharging a mixture of floating particles and ice pieces in the air captured by this frosting unit in a solid state or after fusing temporarily to the outside of the frosting unit.

Differently from cooling apparatuses using chlorofluorocarbon as refrigerant, commonly used air-refrigerant cooling apparatuses are designed to directly introduce air used as refrigerant into cooled chambers, to recover the air from the chambers, and to circulate the air. The air within the chamber is mixed with the external air due to going in and out of loads and persons. This causes the refrigerant air to incorporate moisture of the external air. The moisture within the refrigerant air enhances generation of frost. Accordingly, defrosting is an important issue for air-refrigerant cooling apparatuses.

DISCLOSURE OF INVENTION

Therefore, an object of the present invention is to provide an air-refrigerant cooling apparatus capable that achieves efficient defrosting.

In an aspect of the present invention, an air-refrigerant cooling apparatus is composed of: a compressor compressing refrigerant air; a heat exchanger cooling the refrigerant air discharged from the compressor; an expansion turbine expanding the refrigerant air discharged from the heat exchanger; a defroster removing moisture from the refrigerant air discharged from the expansion turbine; and a cooled chamber supplied with the refrigerant air from the defroster. The refrigerant air discharged from the cooled chamber is supplied to the compressor. The air-refrigerant cooling apparatus additionally includes a cooled chamber bypass pipe allowing the refrigerant air discharged from the defroster to bypass the cooled chamber and to enter a pipe connected to an outlet of the cooled chamber; and a defrosting bypass pipe branched from a pipe connected to an outlet of the compressor to supply the defroster with the refrigerant air.

Preferably, the air-refrigerant cooling apparatus in accordance with the present invention further includes a heat exchanger bypass pipe bypassing the heat exchanger to introduce the refrigerant from the compressor to the expansion turbine.

It is also preferable that air-refrigerant cooling apparatus in accordance with the present invention further includes a device measuring a pressure in the defroster.

Preferably, the air-refrigerant cooling apparatus in accordance with the present invention further includes a defroster drying mechanism exchanging moisture—including air within the defroster with external air.

Preferably, the defroster drying mechanism includes a fan discharging air within the defroster.

It is also preferable that the defroster drying mechanism includes a suction pipe disposed at a position experiencing a relatively low pressure within a pipe system provided for the air-refrigerant cooling apparatus to communicate with the outside of the pipe system; and a discharge pipe disposed at a position experiencing a relatively high pressure within the pipe system to communicate with the outside of the pipe system.

In another aspect of the present invention, an air-refrigerant cooling apparatus in accordance with the present invention is composed of a compressor compressing refrigerant air; a heat exchanger cooling the refrigerant air discharged from the compressor; an expansion turbine expanding the refrigerant air discharged from the heat exchanger; a defroster removing moisture from the refrigerant air discharged from the expansion turbine; and a cooled chamber supplied with the refrigerant air from the defroster. The refrigerant air discharged from the cooled chamber is supplied to the compressor. The air-refrigerant cooling apparatus further includes a defroster drying mechanism exchanging moisture—including air within the defroster with external air.

The air-refrigerant cooling apparatus in accordance with the present invention is especially useful when operating on a transport apparatus.

In still another aspect of the present invention, a defrosting method for an air-refrigerant cooling apparatus in accordance with the present invention involves circulating refrigerant through a pipe system with valves on the inlet and outlet of the cooled chamber opened, and with a valve disposed in the defrosting bypass pipe closed, when the air-refrigerant cooling apparatus is placed into a cooling operation mode for cooling the cooled chamber by the air-refrigerant cooling apparatus. When the air-refrigerant cooling apparatus is placed into a defrosting operation mode for defrosting the defroster, on the other hand, the valves on the inlet and outlet of a cooled chamber are closed, and the valve disposed in the defrosting bypass pipe is opened. Additionally, the refrigerant air is circulated through the pipe system of the air-refrigerant cooling apparatus with a motor for driving the compressor and the expansion turbine operated at a rotational speed lower than that for the cooling operation mode.

In still another aspect of the present invention, a defrosting method for an air-refrigerant cooling apparatus in accordance with the present invention involves circulating refrigerant air through a pipe system with the valves on the inlet and outlet of the cooled chamber opened, and with the valve disposed in the defrosting bypass pipe and the valve disposed in the heat exchange bypass pipe closed, when the air-refrigerant cooling apparatus is placed into a cooling operation mode for cooling the cooled chamber by the air-refrigerant cooling apparatus. When the air-refrigerant cooling apparatus is placed into a defrosting operation mode for defrosting the defroster, on the other hand, the valves on the inlet and outlet of a cooled chamber are closed, and the valve disposed in the defrosting bypass pipe is opened. Furthermore, the motor for driving the compressor and the expansion turbine is operated at a rotational speed lower than that for the cooling operation mode. Additionally, the refrigerant air is circulated through the pipe system of the air-refrigerant cooling apparatus with the valve disposed in the heat exchanger bypass pipe and with a valve introducing the refrigerant air from the compressor to the heat exchanger closed.

In still another aspect of the present invention, a defrosting method for an air-refrigerant cooling apparatus in accordance with the present invention involves switching the operation mode of the air-refrigerant cooling apparatus from the cooling operation mode to the defrosting operation mode when the measured pressure within the defroster being exceeds a predetermined value.

According to the present invention, an air-refrigerant cooling apparatus is provided which achieves efficient defrosting.

BEST MODE FOR CARRYING OUT THE INVENTION

A best mode for carrying out the present invention will be described hereinafter in detail with reference to the drawings.

Figure 1:
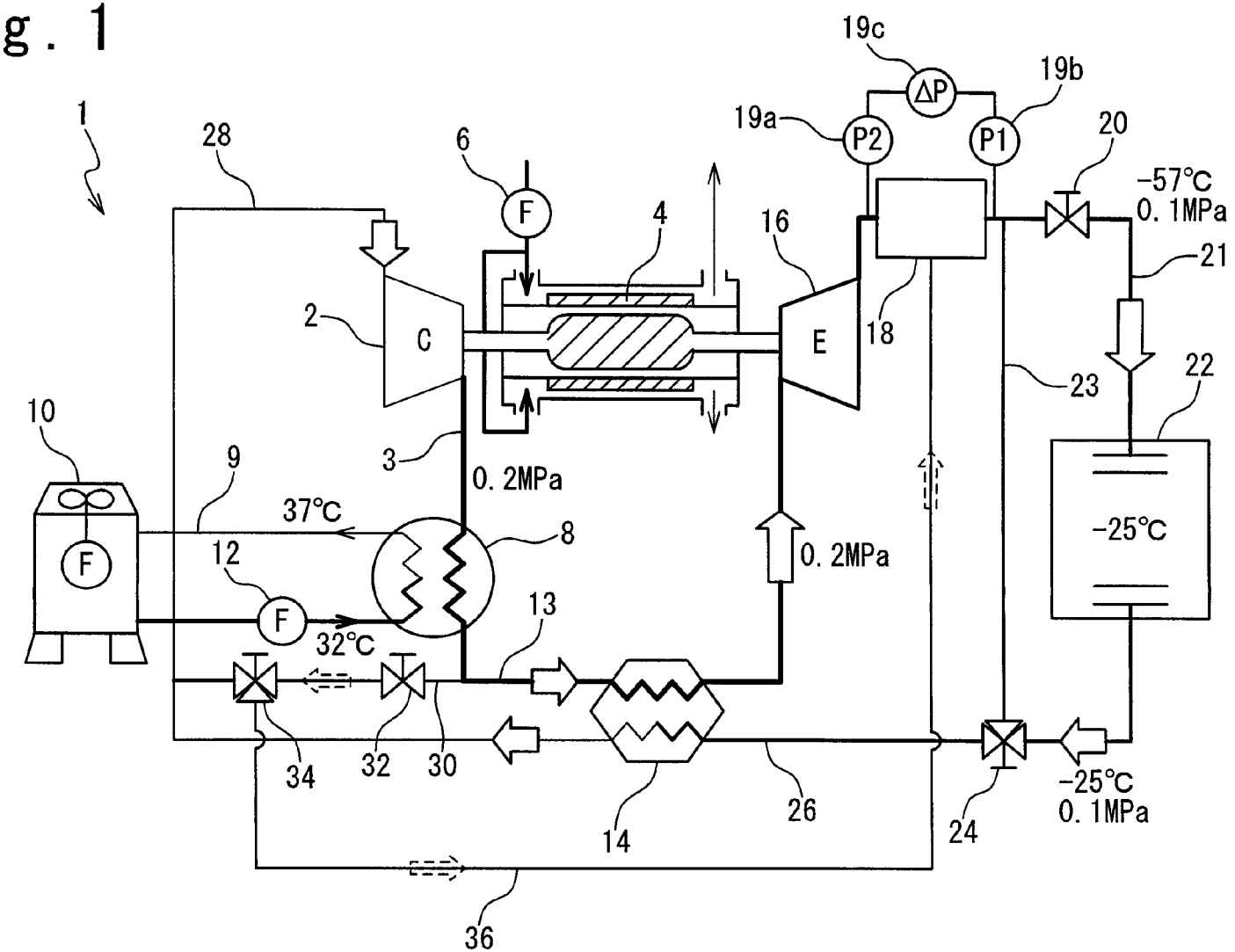
FIG. 1 depicts an air-refrigerant cooling apparatus in a normal operation.

Referring to FIG. 1, shown is an exemplary configuration of an air-refrigerant cooling apparatus according to one embodiment of the present invention. The term "cooling apparatus" is intended to include a freezing apparatus, a refrigerating apparatus, and an air-conditioning cooling apparatus, which are different in temperature and pressure of the system; this also applies to the cooled warehouse. In the following description, the term "warehouse" refers to a space to be cooled by the cooling apparatus. The air-refrigerant cooling apparatus 1 includes a compressor 2. The compressor 2 is driven by a motor 4. The motor 4 is cooled by a cooling fan 6.

A pipe 28 is connected to the inlet of the compressor 2. The outlet of the compressor 2 is connected to a water-cooled heat exchanger 8 through an air pipe 3. The water-cooled heat exchanger 8 includes a water line 9 through which water flows for achieving heat exchange with the air within the air pipe 3. The water line 9 is connected to a cooling tower 10. The water line 9 is provided with a circulating pump 12 for circulating the water between the water-cooled heat exchanger 8 and the cooling tower 10.

A pipe connected to the outlet of the airside of the water-cooled heat exchanger 8 is branched into a high-temperature pipe 13 and a bypass pipe 30. The high-temperature pipe 13 is connected to an inlet of an expansion turbine 16 through an exhaust heat recovery heat exchanger 14. The expansion turbine 16 is driven by compressed air received from the compressor 2.

The outlet portion of the expansion turbine 16 tends to be frosted during cooling operation of the air-refrigerant apparatus 1. On this account, a defroster 18 for removing frost is connected to a pipe on an outlet side of the expansion turbine 16. A pipe on the outlet of the defroster 18 is branched into a cooled warehouse inlet pipe 21 and a bypass line 23. The cooled warehouse inlet pipe 21 is connected to a cooled warehouse 22 through a warehouse inlet valve 20. The cooled warehouse 22 having an openable and closable door; closing the door provides a hermetic space inside the cooled warehouse 22.

A pipe on the outlet of the cooled warehouse 22 is connected to a low-temperature pipe 26 through a warehouse outlet valve 24. The end of the bypass line 23 positioned away from the defroster 18 is connected to the low-temperature pipe 26 at the warehouse outlet valve 24. Namely, the warehouse outlet valve 24 is a three-way valve to which the pipe on the outlet of the cooled warehouse 22, the low-temperature pipe 26, and the bypass line 23 are connected. The low-temperature pipe 26 is connected to the pipe 28 through the exhaust heat recovery heat exchanger 14.

The bypass side pipe 30 is connected to one end of a bypass line 36 through two valves: a balancing root valve 32 and a three-way balancing valve 34. The three-way balancing valve 34 is also connected to a pipe having an end connected to the pipe 28, on the opposite end. The other end of the bypass line 36 is connected to the defroster 18.

The air-refrigerant cooling apparatus 1 constituted as stated above operates as follows in the normal operation, i.e., the operation mode in which the inside of the cooled warehouse 22 is cooled.

The warehouse inlet valve 20 is opened. The warehouse outlet valve 24 is actuated so that the outlet of the bypass line 23 is closed, and the pipe on the outlet of the cooled warehouse 22 and the low-temperature pipe 26 are opened so as to communicate with each other. The balancing root valve 32 and the three-way balancing valve 34 are closed.

The motor 4 is started to thereby drive the compressor 2 and the expansion turbine 16. The compressor 2 absorbs and compresses the refrigerant air in the pipe 28. The refrigerant air, having a high temperature and a high pressure through the compression, is discharged to the air pipe 3. The circulating pump 12 is driven to thereby pump the water through the water line 9. The refrigerant air within the air pipe 3 is cooled through heat exchange with the water circulating through the water line 9 in the water-cooled heat exchanger 8.

The refrigerant air from the water-cooled heat exchanger 8 enters the high-temperature pipe 13. The refrigerant air through the high-temperature pipe 13 is further cooled through heat exchange with the refrigerant air flowing through the low-temperature pipe 26 in the exhaust heat recovery heat exchanger 14.

The refrigerant air cooled by the exhaust heat recovery heat exchanger 14 enters the expansion turbine 16 through the pipe on the outlet of the exhaust heat recovery heat exchanger 14. The refrigerant air is further cooled by being adiabatically expanded by the expansion turbine 16.

The refrigerant air discharged from the expansion turbine 16 enters the defroster 18. In the defroster 18, moisture within the refrigerant air is frozen; moisture concentration of the refrigerant air discharged from the defroster 18 is reduced.

The refrigerant air from the defroster 18 is supplied into the cooled warehouse 22 through the warehouse inlet valve 20, thereby cooling the cooled warehouse 22. The refrigerant air discharged from the cooled warehouse 22 enters the low-temperature pipe 26 through the warehouse outlet valve 24. The refrigerant air flowing through the low-temperature pipe 26 is heated by the heat exchange with the refrigerant air flowing from the high-temperature pipe 13 through the exhaust heat recovery heat exchanger 14. The heated refrigerant air enters the compressor 2 through the pipe 28.

Figure 2:
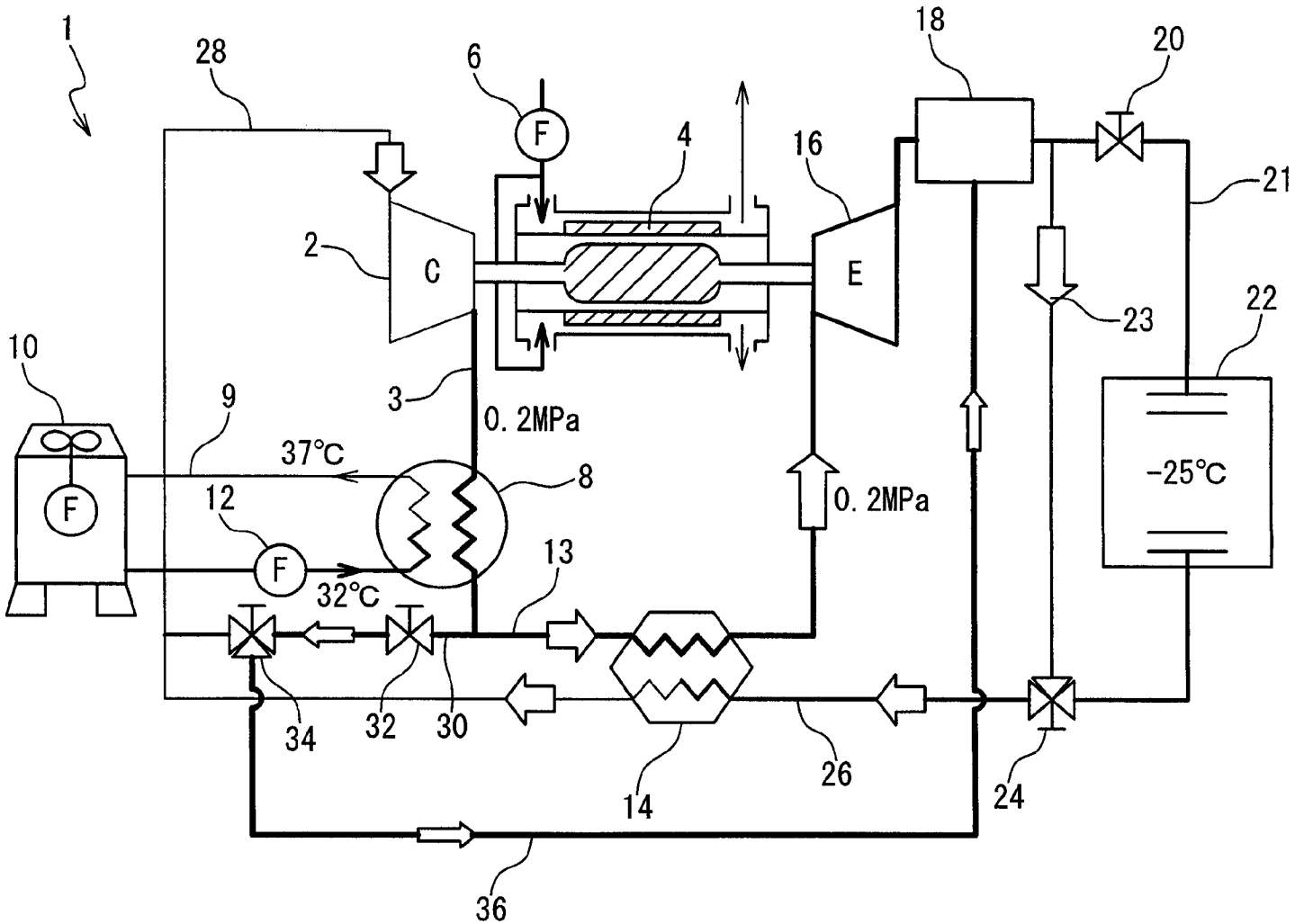
FIG. 2 depicts the air-refrigerant cooling apparatus in a defrosting operation.

Next, an operation of the air-refrigerant cooling apparatus 1 in the defrosting operation mode will be described with reference to FIG. 2.

The warehouse inlet valve 20 is closed. The warehouse outlet valve 24 is actuated so that the pipe on the outlet side of the cooled warehouse 22 is closed, and the bypass line 23 and the low-temperature pipe 26 are opened so as to communicate with each other. The balancing root valve 32 is opened, and the three-way balancing valve 34 is opened so as to communicate the pipe connected to the balancing root valve 32 with the bypass line 36.

The motor 4 is started to operate at a rotational speed smaller than that in the normal operation (e.g., about a one-third of that in the normal operation), thereby driving the compressor 2 and the expansion turbine 16. The compressor 2 absorbs and compresses the refrigerant air in the pipe 28. The refrigerant air, having a high temperature and a high pressure through the compression, is discharged to the air pipe 3. The refrigerant air enters the water-cooled heat exchanger 8. The circulating pump 12 is stopped, so that the refrigerant air is not cooled but kept at high temperature in the water-cooled heat exchanger 8.

The refrigerant air from the water-cooled heat exchanger 8 is branched into the high-temperature pipe 13 and the bypass pipe 30. The part of the refrigerant air that flows through the high-temperature pipe 13 enters the exhaust heat recovery heat exchanger 14, and is cooled in the exhaust heat recovery heat exchanger 14 through heat exchange with the refrigerant air flowing from the low-temperature pipe 26.

It should be noted, however, that the temperature of the air refrigerant during the defrosting operation mode is higher than that during the operation mode of cooling the cooled warehouse 22, because of the reasons that, for example, the rotational speed of the expansion turbine 16 of the air-refrigerant cooling apparatus 1 is small, the air refrigerant is not cooled in the water-cooled heat exchanger 8, and the cold air from the cooled warehouse 22 does not enter the low-temperature pipe 26. Accordingly, a quantity of heat taken from the high-temperature pipe 13 in the exhaust heat recovery heat exchanger 14 is smaller than that in the normal operation.

The refrigerant air discharged from the exhaust heat recovery exchanger 14 enters the expansion turbine 16. In the expansion turbine 16, the refrigerant air 16 is expanded and cooled; however, a temperature difference of the refrigerant air between the inlet and outlet of the turbine 16 is not so greater than that in the normal operation, because of the reduced rotational speed.

The refrigerant air discharged from the expansion turbine 16 is introduced into the bypass line 23 through the defroster 18. The refrigerant air then enters the low-temperature pipe 26 through the warehouse outlet valve 24. The refrigerant air in the low-temperature pipe 26 enters the pipe 28 through the exhaust heat recovery heat exchanger 14. The refrigerant air in the pipe 28 enters the compressor 2.

A part of the refrigerant air discharged from the water-cooled heat exchanger 8 enters the bypass pipe 30. The refrigerant air flowing through the bypass pipe 30 enters the bypass line 36 through the balancing root valve 32 and the three-way balancing valve 34. The refrigerant air flowing through the bypass line 36 is supplied to the defroster 18.

The refrigerant air supplied from the bypass line 36 to the defroster 18 is high in temperature because being directly supplied from the outlet side of the compressor 2, and not cooled by the exhaust heat recovery heat exchanger 14 and the expansion turbine 16. This effectively melts the frost within the defroster 18. Let us consider the case, for example, that it takes two hours to complete defrosting through allowing all the refrigerant air in the bypass line 36 to enter the high-temperature pipe 13, and to enter the defroster 18 through the expansion turbine after the temperature thereof is reduced in the exhaust heat recovery heat exchanger 14. Supplying the refrigerant air discharged from the compressor 2 to the defroster 18 through the bypass line 36, as shown in FIG. 2, achieves defrosting within about 1.5 hours.

The air-refrigerant cooling apparatus 1 according to the present invention may additionally include a bypass that allows the refrigerant air to bypass the water-cooled heat exchanger 8.

In this case, the refrigerant air discharged from the compressor 2 flows through the bypass instead of the water-cooled heat exchanger 8, and is supplied to the defroster 18

Switching from the normal operation to the defrosting operation mode may be automatically achieved through the following techniques:

(1) The apparatus is switched to the defrosting mode at a predetermined time, for instance, every twelve o'clock at night. In this case, it is preferable to perform defrosting at night, when fewer persons and foods go in and out of the cooled warehouse.

(2) A pressure gauge 19*b* is provided for the defroster at some position thereof, for instance, at the outlet thereof. When the pressure satisfies a predetermined condition, for instance, falls by a predetermined pressure or more, the mode is switched to the defrosting mode.

(3) The apparatus is provided with pressure gauges 19*a* and 19*b* measuring the pressures at the inlet and outlet of the defroster, respectively, and a differential pressure gauge 19*c* measuring a differential pressure between the inlet and the outlet are provided. When the differential pressure is equal to or higher than a predetermined pressure, the mode is switched to the defrosting mode.

Figure 3:
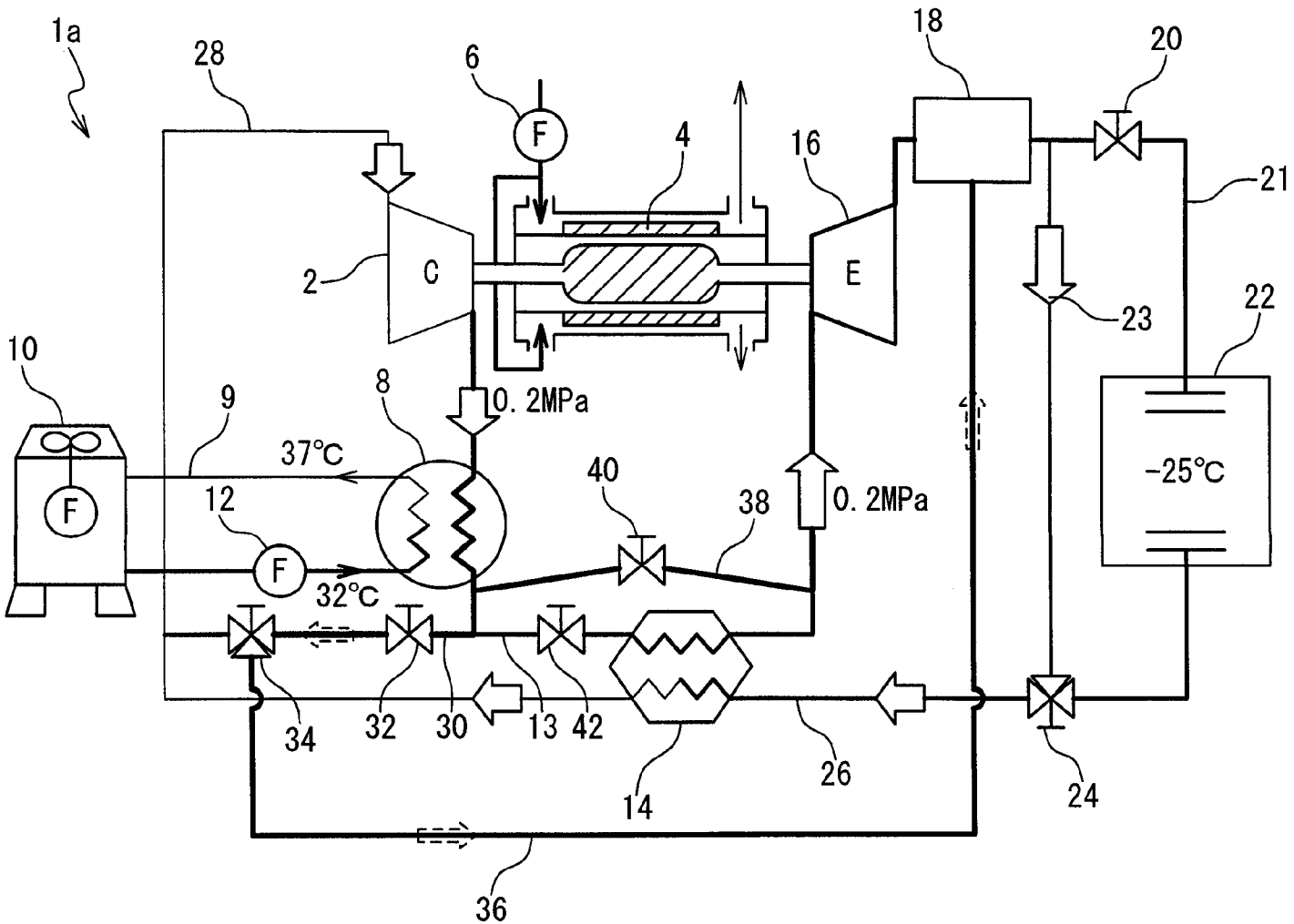
FIG. 3 depicts an air-refrigerant cooling apparatus having a bypass pipe provide in an exhaust heat recovery heat exchanger.

Referring to FIG. 3, a description is made of a modification of this embodiment. The air-refrigerant cooling apparatus 1*a* shown in FIG. 3, as compared with the air-refrigerant cooling apparatus 1 shown in FIG. 1, additionally includes: a pipe 38 that communicates the pipe connected to the outlet of the water-cooled heat exchanger 8 with the pipe introducing the refrigerant air from the exhaust heat recovery heat exchanger 14 to the expansion turbine 18; a valve 40 provided at the pipe 38; and a valve 42 provided on the high-temperature side inlet of the exhaust heat recovery heat exchanger 14.

In this modification, the valve 40 is closed and the valve 42 is opened, during the normal operation, that is, the operation mode for cooling the inside of the cooled warehouse 22. The other operations are identical to those of the air-refrigerant cooling apparatus 1 described with reference to FIG. 1.

According to this modification, the valve 40 is opened and the valve 42 is closed, during the operation mode for defrosting the defroster 18 in the air-refrigerant cooling apparatus 1*a*. In addition, the warehouse inlet valve 20 is closed. The warehouse outlet valve 24 is actuated so that the pipe on the outlet of the cooled warehouse 22 is closed, and the bypass line 23 and the low-temperature pipe 26 are opened so as to communicate with each other. The balancing root valve 32 is opened, and the three-way balancing valve 34 is opened so that the pipe connected to the balancing root valve 32 communicates with the bypass line 36.

Although the refrigerant air discharged from the water-cooled heat exchanger 8 is branched into the high-temperature pipe 13 and the bypass pipe 30 in the embodiment described with reference to FIG. 2, the refrigerant air discharged from the water-cooled heat exchanger 8 is branched into the pipe 38 and the bypass pipe 30 in this modification, since the valve 42 is closed and the valve 40 is opened.

Other operations are identical to those described with reference to FIG. 2. In this modification, the temperature of the refrigerant air is not reduced in the exhaust heat recovery heat exchanger 14, because the pipe 38 bypasses the exhaust heat recovery heat exchanger 14. This achieves defrosting the defroster 18 more efficiently.

Figure 4:
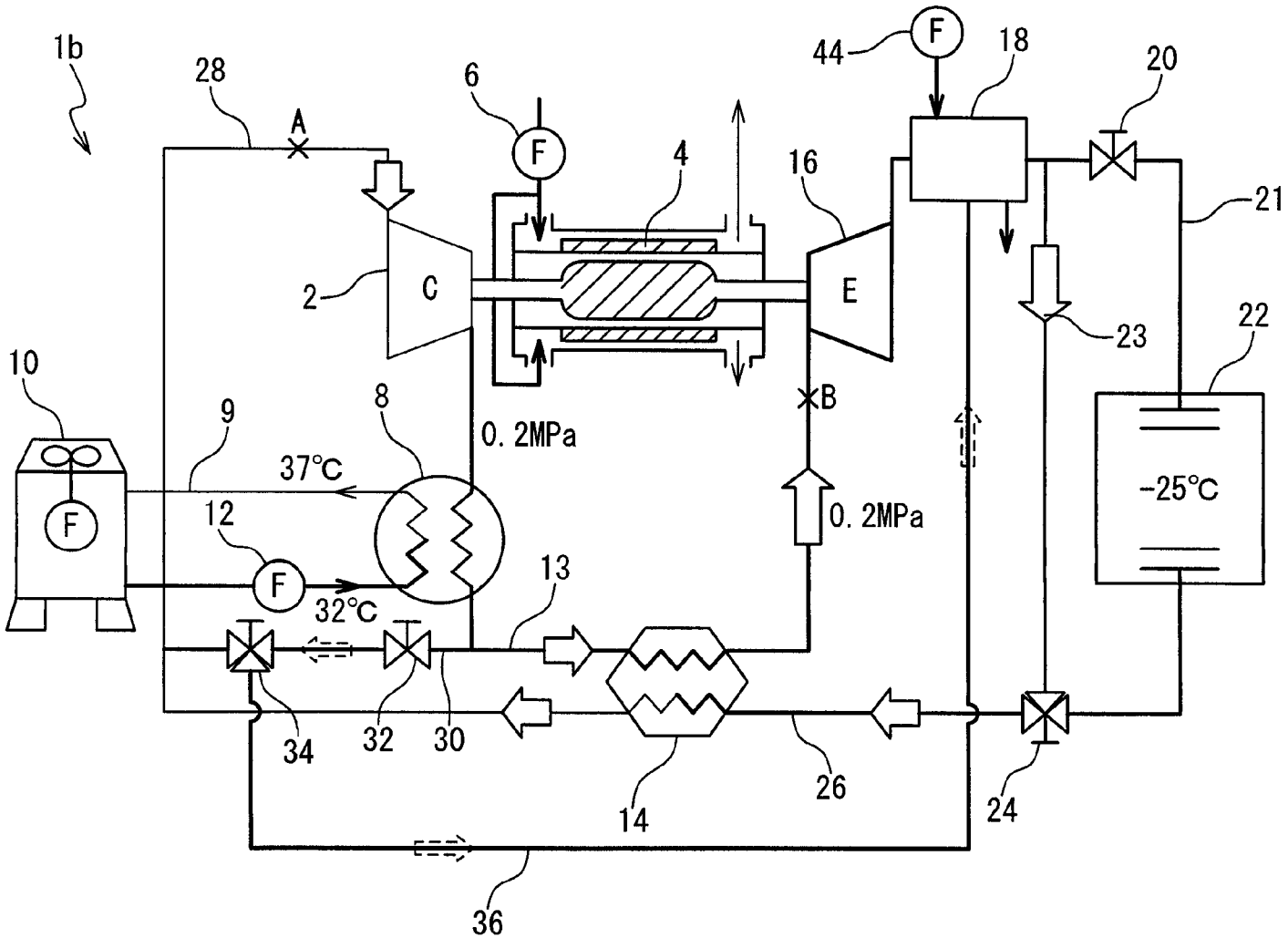
FIG. 4 depicts an air-refrigerant cooling apparatus that includes a moisture discharge fan.

Referring to FIG. 4, a description is made of another modification. An air-refrigerant cooling apparatus 1*b* in this modification provides the defroster 18 with a dehumidification fan 44. The arrangement of other portions of the air-refrigerant cooling apparatus 1*b* is identical to the air-refrigerant cooling apparatus 1 described with reference to FIG. 1. As described with reference to FIG. 3, the pipe 38 and the valves 40 and 42 may be additionally provided for the apparatus 1*b*.

If the high-temperature refrigerant air is supplied into the defroster 18 to melt the frost, and water vapors of the air stay in the defroster 18 and the pipe system, a frost forms on the defroster 18 immediately after the mode is returned to the normal operation mode. It is therefore preferable to exchange the air within the defroster 18 using the dehumidification fan 44 in the defrosting operation mode.

Alternatively, conduits that communicate with the outside of the pipe system may be provided at two or more locations of the pipe system that have different pressures in place of or in addition to the fan 44 so as to exhaust the air using the pressure difference. For example, a suction pipe and a valve may be provided at a position A of the pipe 28 for the low pressure side, and a discharge pipe and a valve may be provided at a position B of the pipe on the inlet of the expansion turbine 16 for the high pressure side. When the valves disposed at the points A and B are opened, the air is taken in the pipe system from the point A and discharged from the point B. This achieves exchanging the air within the pipe system, and reduces the humidity in the pipe system, which is increased through evaporating the frost.

Figure 5:
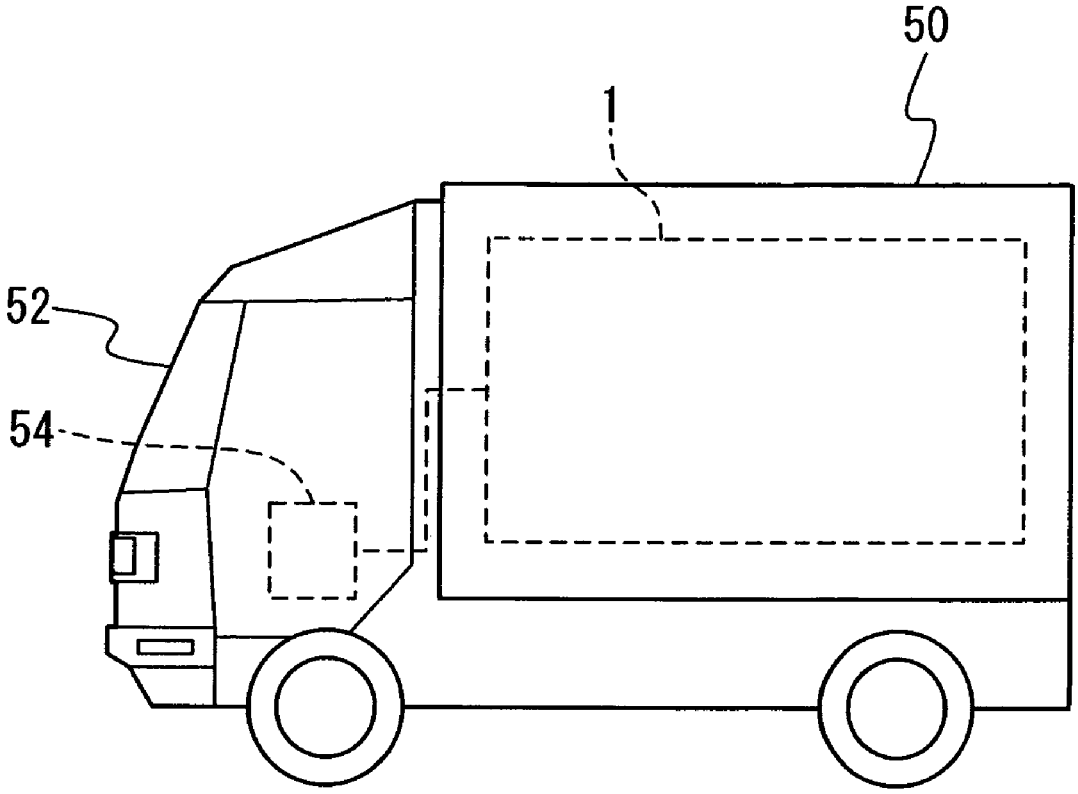
FIG. 5 depicts a transport apparatus loaded with a container that includes the air-refrigerant cooling apparatus.

Although these embodiments are directed to the air-refrigerant cooling apparatus 1 that cools the cooled warehouse, which can be hermetically sealed by closing the door, the present invention is also applicable to a case in which a food or the like on a belt conveyer is passed through a semi-hermetic space cooled by the air-refrigerant cooling apparatus 1 to transform the food into a frozen food. The present invention is also applicable to a medical supply reactor that refrigerates medical supplies in a medical supply manufacturing process. Additionally, as shown in FIG. 5, the present invention is applicable to a cooling container loaded in transport apparatuses such as a vehicle, a ship, an airplane, or a train. In an embodiment shown in FIG. 5, a container 50 including the air-refrigerant cooling apparatus 1 is loaded on a transport apparatus 52. The transport apparatus 52 is equipped with a battery 54, and power is supplied to the air-refrigerant cooling apparatus 1 from the battery 54.

The invention claimed is:

1. An air-refrigerant cooling apparatus comprising:

a compressor compressing refrigerant air;

a water-cooled heat exchanger cooling said refrigerant air discharged from said compressor through heat exchange with water;

an exhaust heat recovery heat exchanger cooling said refrigerant air discharged from said water-cooled heat exchanger;

an expansion turbine expanding said refrigerant air discharged from said exhaust heat recovery heat exchanger;

a defroster removing moisture from said refrigerant air discharged from said expansion turbine;

a cooled chamber supplied with said refrigerant air from said defroster, said refrigerant air discharged from said cooled chamber being supplied to said compressor through said exhaust heat recovery heat exchanger to provide heat exchange between said refrigerant air discharged from said water-cooled heat exchanger and said refrigerant air discharged from said cooled chamber;

a cooled chamber bypass pipe allowing said refrigerant air discharged from said defroster to bypass said cooled chamber and to enter a pipe connected to an outlet of said cooled chamber; and a defrosting bypass pipe branched from a pipe connected between said water-cooled heat exchanger and said exhaust heat recovery heat exchanger to supply said defroster with said refrigerant air discharged from said water-cooled heat exchanger.

2. The air-refrigerant cooling apparatus according to claim 1, further comprising:

a heat exchanger bypass pipe bypassing said exhaust heat recovery heat exchanger to introduce said refrigerant from said compressor to said expansion turbine.

3. The air-refrigerant cooling apparatus according to claim 1, further comprising:

a device measuring a pressure in said defroster.

4. The air-refrigerant cooling apparatus according to claim 1, further comprising:

a defroster drying mechanism exchanging moisture—including air within said defroster with external air.

5. The air-refrigerant cooling apparatus according to claim 4, wherein said defroster drying mechanism includes a fan discharging air within said defroster.

6. The air-refrigerant cooling apparatus according to claim 4, wherein said defroster drying mechanism includes:

a suction pipe disposed at a position experiencing a relatively low pressure within a pipe system provided for said air-refrigerant cooling apparatus to communicate with the outside of said pipe system, and a discharge pipe disposed at a position experiencing a relatively high pressure within said pipe system to communicate with the outside of said pipe system.

7. The air-refrigerant cooling apparatus according to claim 1, wherein said air-refrigerant cooling apparatus has a plurality of operation modes including a cooling operation mode for cooling said cooled chamber, and a defrosting mode for defrosting said defroster;

wherein said refrigerant air is cooled by said water-cooled heat exchanger, when said air-refrigerant cooling apparatus is placed into said cooling operation mode, and wherein said refrigerant air is not cooled by said water-cooled heat exchanger, when said air-refrigerant cooling apparatus is placed into said defrosting mode.

8. A transport apparatus comprising:

an air-refrigerant cooling apparatus including:

a compressor compressing refrigerant air;

a water-cooled heat exchanger cooling said refrigerant air discharged from said compressor through heat exchange with water;

an exhaust heat recovery heat exchanger cooling said refrigerant air discharged from said water-cooled heat exchanger;

an expansion turbine expanding said refrigerant air discharged from said exhaust heat recovery heat exchanger;

a defroster removing moisture from said refrigerant air discharged from said expansion turbine;

a cooled chamber supplied with said refrigerant air from said defroster, said refrigerant air discharged from said cooled chamber being supplied to said compressor through said exhaust heat recovery heat exchanger to provide heat exchange between said refrigerant air discharged from said water-cooled heat exchanger and said refrigerant air discharged from said cooled chamber;

a cooled chamber bypass pipe allowing said refrigerant air discharged from said defroster to bypass said cooled chamber and to enter a pipe connected to an outlet of said cooled chamber; and a defrosting bypass pipe branched from a pipe connected between said water-cooled heat exchanger and said exhaust heat recovery heat exchanger to supply said defroster with said refrigerant air discharged from said water-cooled heat exchanger.

9. A method for operating an air-refrigerant cooling apparatus including:

a compressor compressing refrigerant air;

a water-cooled heat exchanger cooling said refrigerant air discharged from said compressor through heat exchange with water;

an exhaust heat recovery heat exchanger cooling said refrigerant air discharged from said water-cooled heat exchanger;

an expansion turbine expanding said refrigerant air discharged from said exhaust heat recovery heat exchanger;

a defroster removing moisture from said refrigerant air discharged from said expansion turbine;

a cooled chamber supplied with said refrigerant air from said defroster, said refrigerant air discharged from said cooled chamber being supplied to said compressor through said exhaust heat recovery heat exchanger to provide heat exchange between said refrigerant air discharged from said water-cooled heat exchanger and said refrigerant air discharged from said cooled chamber;

a cooled chamber bypass pipe allowing said refrigerant air discharged from said defroster to bypass said cooled chamber and to enter a pipe connected to an outlet of said cooled chamber; and a defrosting bypass pipe branched from a pipe connected between said water-cooled heat exchanger and said exhaust heat recovery heat exchanger to supply said defroster with said refrigerant air discharged from said water-cooled heat exchanger, said method comprising:

placing said air-refrigerant cooling apparatus into selected one of a plurality of operation modes including a cooling operation mode for cooling said cooled chamber, and a defrosting mode for defrosting said defroster;

in response to said air-refrigerant cooling apparatus being placed into said cooling operation mode, opening valves disposed on an inlet and outlet of said cooled chamber, and closing a valve disposing in said defrosting bypass line; and in response to said air-refrigerant cooling apparatus being placed into said defrosting operation mode, closing said valves disposed on said inlet and outlet of said cooled chamber, and opening said valve disposing in said defrosting bypass line, with a motor for driving said compressor and said expansion turbine operated at a rotational speed lower than that for said cooling operation mode.

10. The method according to claim 9, wherein said air-refrigerant cooling apparatus further includes a heat exchanger bypass pipe bypassing said exhaust heat recovery heat exchanger to introduce said refrigerant from said compressor to said expansion turbine, and said method further comprising:

opening a valve disposed in said heat exchanger bypass pipe and closing a valve introducing said refrigerant air discharged from said compressor into said heat exchanger, when said air-refrigerant cooling apparatus is placed into said defrosting operation mode.

11. The method according to claim 9, wherein said air-refrigerant cooling apparatus further includes a device measuring a pressure in said defroster, and said method further comprising:

switching said air-refrigerant cooling apparatus from said cooling operation mode to said defrosting operation mode in response to said measured pressure.

12. The method according to claim 9, wherein said refrigerant air is cooled by said water-cooled heat exchanger, when said air-refrigerant cooling apparatus is placed into said cooling operation mode, and wherein said refrigerant air is not cooled by said water-cooled heat exchanger, when said air-refrigerant cooling apparatus is placed into said defrosting mode.

* * * * *